United States Patent [19]

Ledbetter

[11] Patent Number: 4,821,530

[45] Date of Patent: Apr. 18, 1989

[54] AIR-CONDITIONING REFRIGERATOR

[76] Inventor: Ricky G. Ledbetter, 503 Maple St., Medford, Oreg. 97501

[21] Appl. No.: 193,933

[22] Filed: May 13, 1988

[51] Int. Cl.[4] ..... F25B 25/00

[52] U.S. Cl. ..... 62/332; 62/337; 62/440; 62/447; 62/448

[58] Field of Search ..... 62/331, 332, 335, 336, 62/337, 326, 440, 447, 448, 449

[56] References Cited

U.S. PATENT DOCUMENTS

| | | | |
|---|---|---|---|
| 2,437,417 | 3/1948 | Bookman | 62/337 X |
| 2,475,615 | 7/1949 | Houting | 62/326 X |
| 2,697,333 | 12/1954 | Weiss | 62/337 X |
| 3,123,986 | 3/1964 | Lukas et al. | 62/337 X |
| 3,166,912 | 1/1965 | Patrick | 62/337 X |

*Primary Examiner*—Lloyd L. King
*Attorney, Agent, or Firm*—John F. Ingman

[57] ABSTRACT

An air-conditioning refrigerator comprising an air-conditioning unit structured within the confines of a refrigerator, with the cooling coil and blower of the air conditioner located within a housing attached to the inside of the freezer compartment door, with air flow through apertures in that door; the motor-compressor unit located beneath the refrigeration compartment; and a water-cooled condensor unit located on the back surface of the refrigerator. Freon lines and condensate discharge tubing may enter and leave the housing through apertures formed at rotational axes of freezer and refrigerator door hinges.

10 Claims, 3 Drawing Sheets

AIR-CONDITIONING REFRIGERATOR

BACKGROUND OF THE INVENTION

1. Field of the Invention

This invention involves an air-conditioning refrigerator, and, more particularly, an air conditioner which is installed, in combination with a refrigerator, within the refrigerator housing.

2. Description of the Prior Art

It is common knowledge, at least among homemakers, that the kitchen is the warmest part of the house. This is due, at least in part, to the fact that heat generating appliances, such as conventional stoves and refrigerators, are located within the kitchen. One solution, when the temperature gets excessive, is to start the centralized air conditioner, if one is available, to overcome kitchen discomfort (the kitchen also is a high humidity area). This, however, is a very inefficient manner of cooling a single room—the thermostat is infrequently located in the kitchen and thus the remainder of the house may be overcooled in order to obtain a comfortable kitchen.

Alternatively, a standard window air-conditioning unit may be considered. A window air conditioner for the kitchen, however, may not be practicable, depending on the design of the kitchen. Generally, in a kitchen, a window air-conditioning unit is less than optimum, tending to block out already limited light and view. In addition, in many kitchens, space is at a premium and there may not be room for a separate window air conditioner.

There is a need for an air-conditioning unit installation which is universally suitable for kitchen application, not blocking light or view, nor taking up additional space.

SUMMARY OF THE INVENTION

The present invention provides an air-conditioning refrigerator designed to satisfy the aforementioned need. The invention involves an air conditioner built directly into the common refrigerator, utilizing space available within the refrigerator itself.

Accordingly, the air-conditioning refrigerator, in the preferred embodiment, comprises an air-conditioning unit structured within the confines of a refrigerator, with the cooling coil and blower of the air conditioner located within a housing attached to the inside of the freezer compartment door, with air flow through apertures in that door; the motorcompressor unit located beneath the refrigerator compartment; and a water-cooled condensor unit located on the back surface of the refrigerator. Freon lines and condensate discharge tubing may enter and leave the housing through aperatures formed at rotational axes of freezer and refrigerator compartment door hinges.

DESCRIPTION OF THE PREFERRED EMBODIMENT

Figure 1:
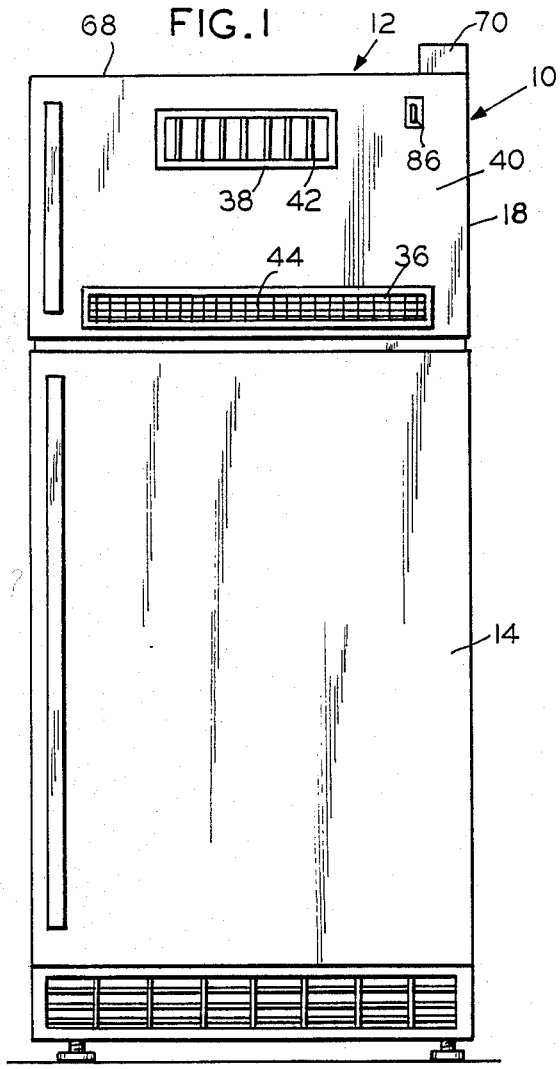
FIG. 1 illustrates a front view of the air-conditioning refrigerator.
Figure 2:
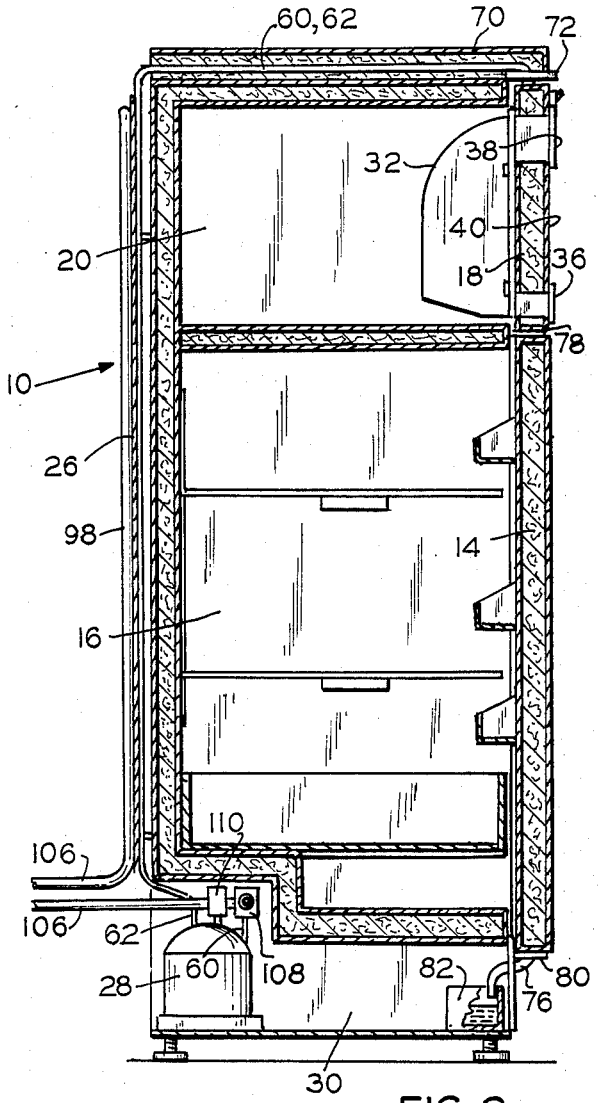
FIG. 2 illustrates a side view, in section, of the air-conditioning refrigerator.

Referring now to the drawings, the preferred embodiment of the air-conditioning refrigerator 10 may be seen. A typical refrigerator-freezer 12 is shown wherein a refrigerator door 14 provides access to the refrigeration compartment 16 while a smaller freezer door 18, commonly located above the large door 14, provides access to the freezer compartment 20. A refrigerator-freezer motor-compressor unit 22 is normally located beneath the refrigeration compartment 16 with the refrigerator-freezer condensor coils 24 located in a plane adjacent to the back surface 26 of the refrigerator-freezer 12. While the form of the refrigerator-freezer 12 may vary somewhat from brand to brand, and from model to model, the operation of such refrigerator-freezer is well understood to those skilled in the art.

In the preferred embodiment of the present invention, an air conditioner motor-compressor unit 28 is located in the open space 30 beneath the refrigeration compartment 16 and adjacent to the refrigerator-freezer motor-compressor unit 22, there normally being ample room for both motor-compressor units 22 and 28.

Figure 7:
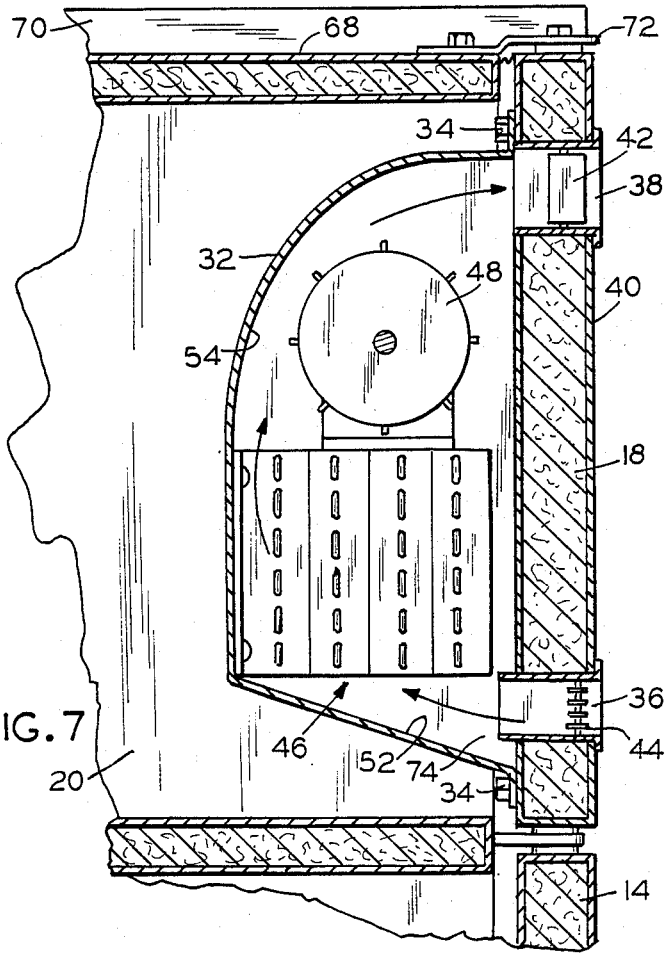
FIG. 7 shows a sectional side view of the cooling coils and blower within the air conditioner housing.
Figure 8:
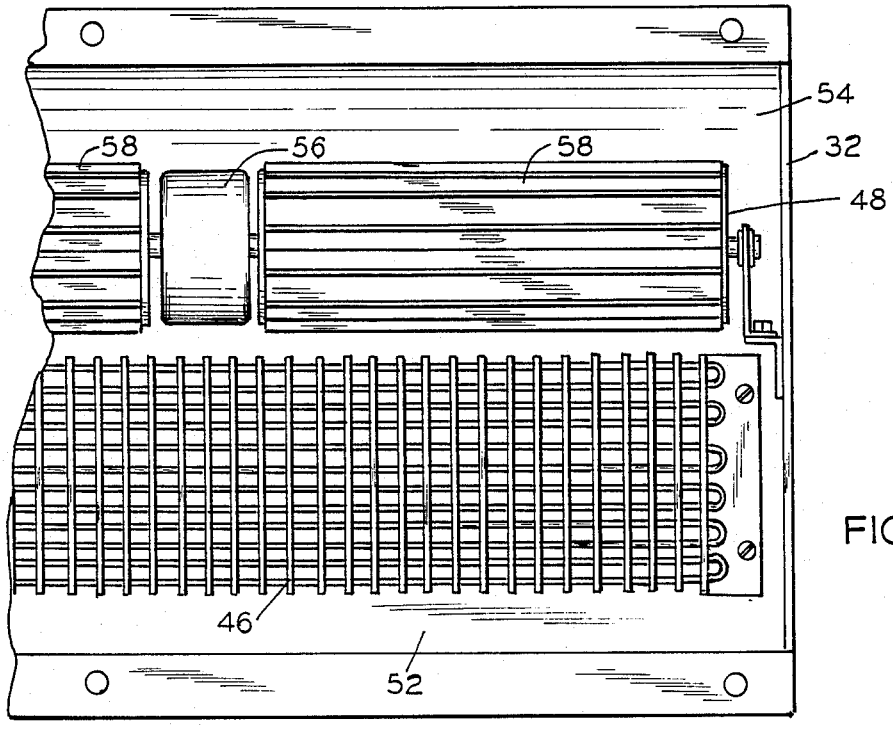
FIG. 8 illustrates a partial front view of the cooling coils and blower within the air conditioner housing.

An air conditioner housing 32 is attached to the inside of the freezer door 18 by bolts 34 or the like, and extends into the freezer compartment 20, normally replacing the freezer door 18 storage racks or compartments (not shown). The air conditioner housing 32 encloses a warm air entrance 36 and a cold air exit 38, both formed in the exterior surface 40 of the freezer door. The cold air exit 38 may include directional louvers 42 to guide the general direction of the cooled air, while the warm air entrance 36 may include a protective grating 44. The air conditioner housing 32 also encloses and supports the air-conditioning cooling coil unit 46 and a blower and motor unit 48, the blower and motor unit 48 pulling warmer air in through the warm air entrance 36, past the cooling coil unit 46, and exhausting the cooled air out through the cold air exit 38. The flow of air within the air conditioner housing 32 is guided by surfaces 52 and 54, as illustrated at FIG. 7. An air conditioning cooling coil unit 46, consisting of a six-row medium temperature coil with eight fins per inch and rated at 2,950 BTU at 40 degrees suction temperature has worked well. A 115 volt dual shaft motor 56 with 3-inch diameter squirrel cage wheels 58, rated at 200 cfm at 0.25-in static pressure, provides satisfactory blowing characteristics.

Two freon lines 60 and 62, connect the cooling coil unit 46 within the air-conditioning housing 32 with the air conditioner motor-compressor unit 28 in the open space 30 beneath the refrigerator compartment 16.

Freon supply line 60 supplies compressed freon to the air-conditioner cooling coil unit 46 through the condensor 98 (described subsequently) from the air-conditioning motor compressor unit 28. Freon return line 62 returns the expanded freon from the air-conditioning cooling coil unit 46. Conventional ⅜-inch copper tubing works satisfactorily for the freon lines 60 and 62. The freon lines 60 and 62 run from the back surface 26 and along the top 68 of the refrigerator-freezer 12, preferably within a covered casing 70 to the top hinge 72 of the freezer door 18, whereat they proceed vertically downward through the hinge 72 into the freezer door 18 and air-conditioning housing 32 for connection to the cooling coil unit 46. Within the freezer door 18, commonly used flex-lines 64 and 66 are applied to the freon lines 60 and 62 to absorb the ninety degree twisting inherent in the opening and closing of the freezer door 18.

Condensate is drained from the sump 74 air conditioner housing 32 through a plastic tube 76 passing through hollow hinges 78 and 80 of the refrigerator compartment door 14 to a condensate holding vessel 82 located in the open space 30 beneath the refrigeration compartment 16.

An electric cable 84 providing electric power to the blower motor 56 and connection to switch 86 on the outside surface 40 of the freezer compartment door 18 also proceeds through hollow hinges 78 and 80. A three position electrical power switch 86 is located conveniently on the outside surface 40 of the freezer door 18, wherein both the air conditioner motor-compressor 28 and the blower and motor unit 48 can be turned on at one position, or if the user desires, just the blower and motor unit 48 will operate to provide ventilation in the second position. The third position is the power-off position.

Figure 6:
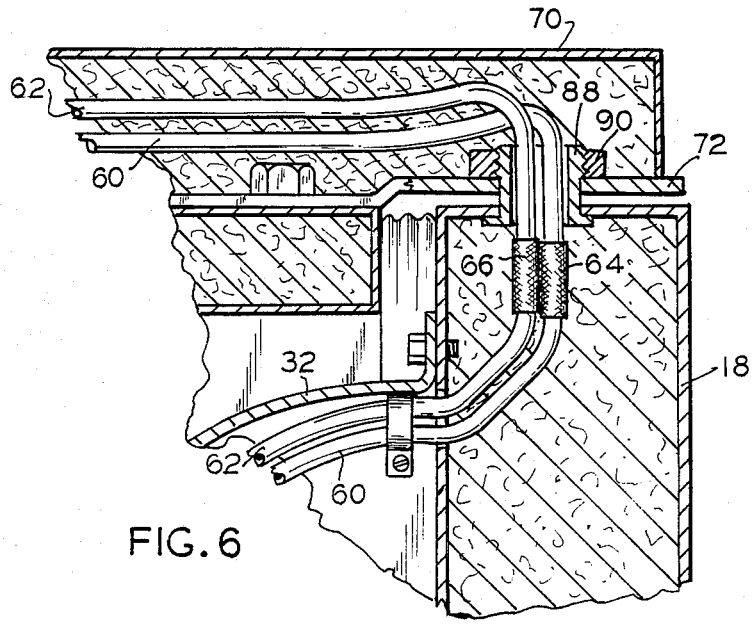
FIG. 6 shows means of entry of freon lines through the upper freezer compartment door hinge into the air conditioner housing.
Figure 9:
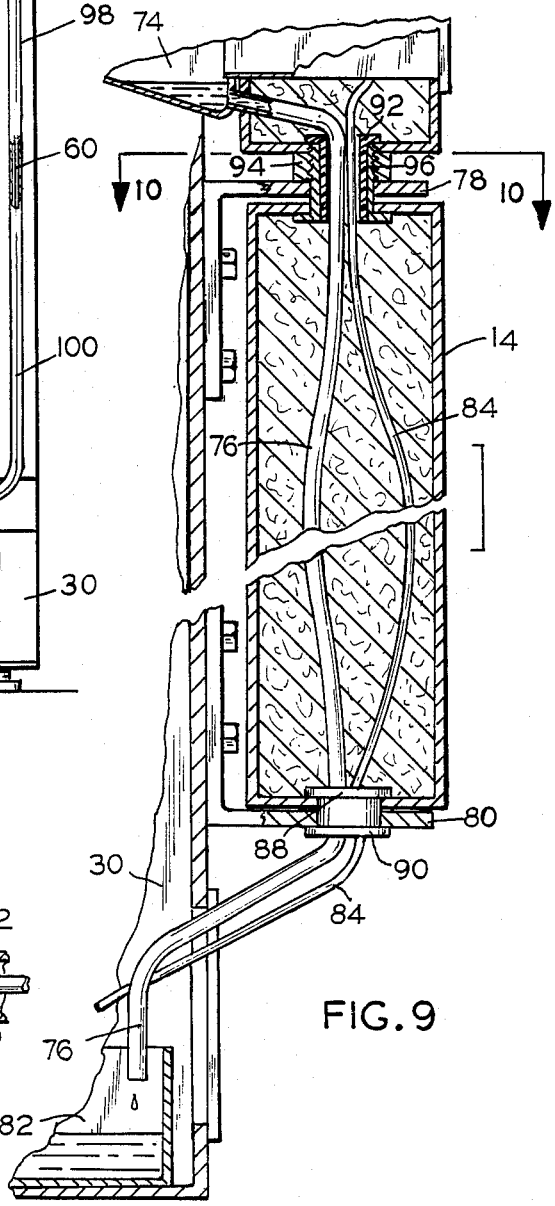
FIG. 9 illustrates means of passage of condensate tubing and electric cable from the air conditioner housing, through refrigerator compartment door hinges, to beneath the refrigeration compartment.
Figure 10:
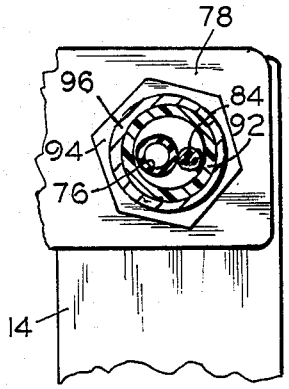
FIG. 10 shows a cross section of the hollow hinge as seen at 10—10 of FIG. 9.

The hollow hinges 72 and 80 are of common design wherein an aperture has been formed through the axis of rotation the hinge 72 or 80 and threaded bushing 88 is inserted therein and secured with a nut 90. Hinge 78 is formed similarly but is used to support the freezer door 18 as well as the refrigerator door 14. Concentric bushings 92 and 96 are used, the outer bushing 96 being threaded and engaging with a threaded spacer 94. The hollow hinge 72, 78 and 80 design is preferably utilized so that the opening and closing of the doors 14 and 18 will limit the flexing of the flex-lines 64 and 66, the condensate tube 76 and the electric cable 84 passing therethrough to approximately a 90-degree twist and thereby add to the reliability of the unit. The hinges are best seen in FIGS. 6, 9, and 10.

Within the air-conditioning process, it is clear that in creating cooled air to be blown though the cold air exit 38, heat will be created, as in the condensing portion of the cycle. As noted above, in the common refrigerator-freezer 12, the refrigerator-freezer condensing coils 24 are located generally parallel the back surface 26 of the refrigeratorfreezer 12 to dissipate the heat so generated. However, the blowing of air-conditioned cool air out of the front of the refrigerator-freezer 12 while heating the back surface 26 or the open space 30 beneath the refrigeration compartment will not improve the overall temperature of the kitchen. Therefore, rather than utilize standard air-exchange refrigerator coils, as at 24, to condense the freon to the liquid form with corresponding emission of heat to the immediate area, the preferred embodiment condenses the freon and expels the condensate heat from the area by means of water cooling. Thus a water-cooled condensor 98 is located on the freon supply line 60 between the air-conditioning compressor-motor 28 and the air-conditioning cooling unit 46. While installable at other locations, including the open space 30 beneath the refrigeration compartment 16, it has been found convenient to locate the water-cooled condensor 98 at the back surface 26 of the refrigerator-freezer 12.

Figure 3:
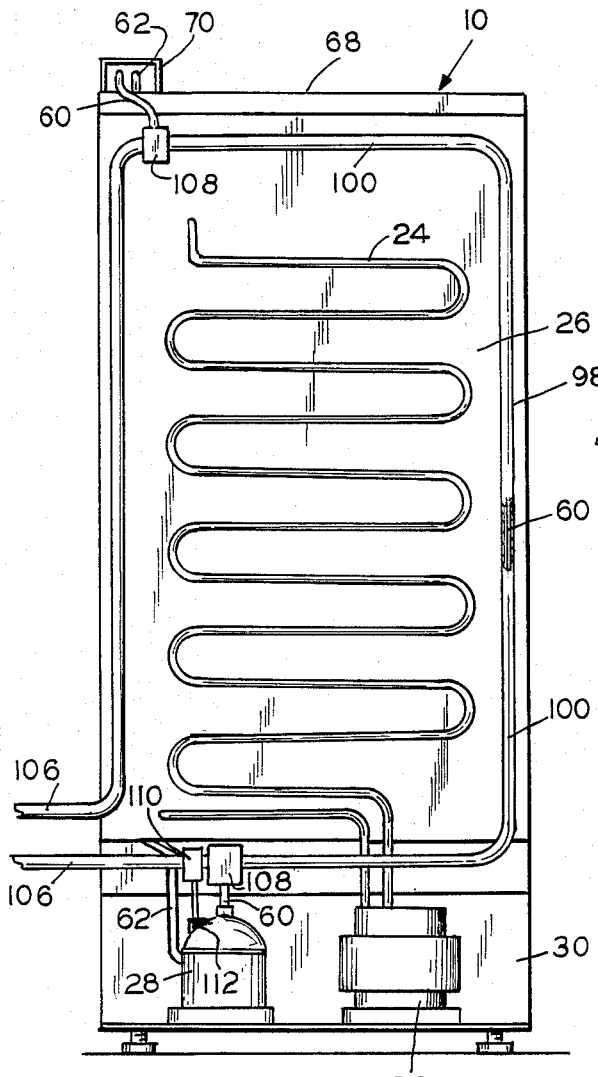
FIG. 3 illustrates a back view of the air-conditioning refrigerator.
Figure 4:
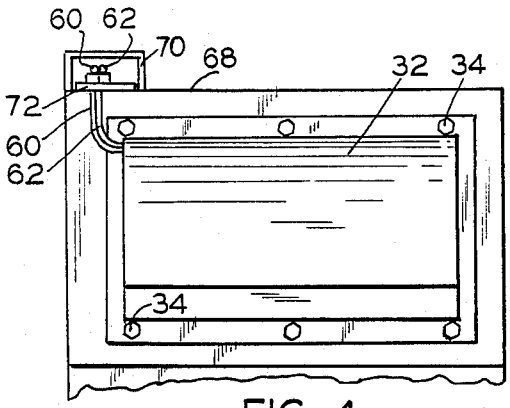
FIG. 4 shows a back view of the air conditioner housing as attached to the inside of the freezer compartment door.

The preferred water-cooled condensor 98 is of tube-in-tube design, wherein the hot freon supply line 60 is encompassed by a water-containing tube 100 of greater diameter, wherein the water in contact with the surface 102 of the hot freon supply line 60 extracts heat therefrom. A water-cooled condensor 98 of ten feet in length, formed in a U-shape at the back surface 26 of the refrigerator-freezer 12, as best seen in FIG. 3, and utilizing a ¾-inch diameter water-carrying tube 100, has proved to be satisfactory.

Figure 5:
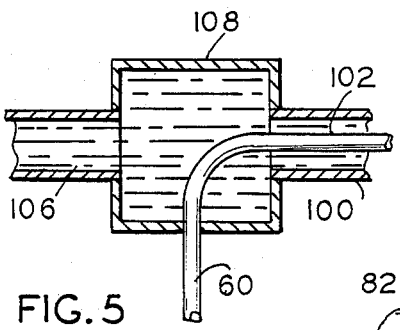
FIG. 5 shows a junction of water and freon tubing of the water-cooled condensor.

A water line 106, similar to those lines used in refrigerator-freezers 12 for automatic ice-cube making and cold water dispensing may be used to provide the cooling water to the water-cooled condensor 98. In fact, if such line already exists, it may be tapped for the water supply, thereby eliminating a duplicate inlet water installation. A junction 108 of water line 106 with freon line 60, as located at each end of the condensor 98, is shown at FIG. 5. A water regulator valve 110 is used in the water line 106 to control the flow therein. A commercially available automatic water regulator valve with automatic shut-off is preferred, the valve being controlled by a head pressure sensor 112 located at the motor-compressor 28, so as to provide an flow of cooling water consistent with the need for freon cooling. The water heated within the water-cooled condensor 98 can be directed to a drain (not shown). Should the local area not permit the use of water for such purposes, or if it is economically impractical, the cooling process also may be conducted by the use of a remote (out-of-kitchen) air-cooled condensor unit, as will be appreciated by those skilled in the art.

It is thought that the air-conditioning refrigerator of the present invention and its many attendant advantages will be understood from the foregoing description and that it will be apparent that various changes may be made in form, construction and arrangement of the parts thereof without departing from the spirit and scope of the invention or sacrificing all of its material advantages, the forms hereinbefore stated being merely exemplary embodiments thereof.

I claim:

1. An air-conditioning refrigerator which, in combination with a conventional refrigerator having separate freezer and refrigeration compartments, with separate freezer compartment and refrigeration compartment doors, comprises the following:

an air-conditioning cooling coil unit;

a blower and motor unit;

an enclosing housing attached to the inside of the freezer compartment door within which the air conditioning cooling coil unit and the blower and motor unit are located;

the freezer compartment door having a first opening for entry of air and a second opening for the exit of cooler air;

the blower and motor unit being positioned as to draw air in through the first opening in the freezer compartment door, past the air-conditioning cooling coil unit, and out through the second opening in the freezer compartment door;

an air-conditioning motor-compressor unit;

freon lines interconnecting said motor-compressor unit and said cooling coil unit;

freon condensing means located between said motor-compressor unit and said cooling coil unit.

2. The air-conditioning refrigerator recited in claim 1, wherein said freon condensing means includes a water-cooled condensor.

3. The air-conditioning refrigerator recited in claim 2, wherein said water-cooled condensor comprises concentric tubing, wherein inner tubing transports freon in a heated state, and outer tubing, of greater diameter, transports circulating cooling water in contact with the inner tubing, wherein the circulating cooling water removes heat from the inner tubing and its transported freon.

4. The air-conditioning refrigerator recited in claim 3, wherein the outer tube of said water-cooled condensor comprises approximately ten feet of ¾-inch diameter water-carrying tubing concentrically oriented about the inner freon carrying tubing of ⅜-inch diameter.

5. The air-conditioning refrigerator recited in claim 3, wherein the flow of water through said outer tubing is regulated by an automatic water valve controlled by the head pressure of the compressor.

6. The air-conditioning refrigerator recited in claim 3, wherein said water-cooled condensor is mounted on the back of the refrigerator.

7. The air-conditioning refrigerator recited in claim 1, wherein a three-way electrical switch is located on the freezer compartment door, with a first position to operate both the motor-compressor unit and the blower and motor unit, a second position to operate only the blower and motor unit, and a third position as a power off position.

8. The air-conditioning refrigerator recited in claim 1, where the freon lines enter the freezer compartment door through an aperature formed at the rotational axis of a hinge of the freezer compartment door.

9. The air-conditioning refrigerator recited in claim 1, which additionally includes condensate discharge tubing which proceeds through aperatures formed at rotational axes of hinges of the refrigerator compartment door so as to carry condensate water away from said housing.

10. An air-conditioning refrigerator which, in combination with a conventional refrigerator having separate freezer and refrigeration compartments, with separate freezer compartment and refrigeration compartment doors, comprises the following:

an air-conditioning cooling coil unit;

a blower and motor unit;

an enclosing housing attached to the inside of the freezer compartment door within which the air conditioning cooling coil unit and the blower and motor unit are located;

the freezer compartment door having a first opening for entry of air and a second opening for the exit of cooler air;

the blower and motor unit being positioned as to draw air in through the first opening in the freezer compartment door, past the air-conditioning cooling coil unit, and out through the second opening in the freezer compartment door;

an air-conditioning motor-compressor unit;

freon lines interconnecting said motor-compressor unit and said cooling coil unit, wherein the freon lines enter the freezer compartment door through an aperature formed at the rotational axis of a hinge of the freezer compartment door;

freon condensing means located between said motor-compressor unit and said cooling coil unit which includes a water-cooled condensor comprising concentric tubing, wherein inner tubing transports freon in a heated state, and outer tubing, of greater diameter, transports circulating cooling water in contact with the inner tubing, wherein the circulating cooling water removes heat from the inner tubing and its transported freon; and condensate discharge tubing which proceeds through aperatures formed at rotational axes of hinges of the refrigerator compartment door so as to carry condensate water away from said housing.

* * * * *